US006874201B2

(12) United States Patent
Ta et al.

(10) Patent No.: US 6,874,201 B2
(45) Date of Patent: Apr. 5, 2005

(54) TOOL EXTENSION ASSEMBLY WITH QUICK RELEASE LOCK MECHANISM

(75) Inventors: Duong L. Ta, Strongsville, OH (US); Ty J. Oliver, Fostoria, OH (US)

(73) Assignee: The Sherwin-Williams Company, Cleveland, OH (US)

( * ) Notice: Subject to any disclaimer, the term of this patent is extended or adjusted under 35 U.S.C. 154(b) by 34 days.

(21) Appl. No.: 10/636,010

(22) Filed: Aug. 7, 2003

(65) Prior Publication Data

US 2004/0128796 A1 Jul. 8, 2004

Related U.S. Application Data

(60) Provisional application No. 60/401,992, filed on Aug. 7, 2002.

(51) Int. Cl.[7] ..... B25G 3/00

(52) U.S. Cl. ..... 16/429; 16/115; 16/427; 403/345

(58) Field of Search ..... 16/110.1, 422, 16/426, 427, 429, 114 R, 115; 294/53.5, 57; 403/109.1–109.3, 109.6, 116, 92, 93, 101, 345; 15/144.1–144.4, 143.1; 81/177.1, 489, 177.2, 177.8–177.9

(56) References Cited

U.S. PATENT DOCUMENTS

| | | | | |
|---|---|---|---|---|
| 2,527,256 A | | 10/1950 | Jackson | 287/119 |
| 3,596,946 A | * | 8/1971 | Burton et al. | 403/109.5 |
| 4,582,079 A | | 4/1986 | Fields | 135/75 |
| 4,662,771 A | * | 5/1987 | Roe et al. | 403/108 |
| 5,186,197 A | | 2/1993 | Lavine | 135/25.4 |
| 5,288,160 A | | 2/1994 | Li et al. | 401/198 |
| 5,288,161 A | | 2/1994 | Graves et al. | 403/324 |
| 5,375,286 A | | 12/1994 | Harrah | 15/147.1 |
| 5,392,673 A | | 2/1995 | Scott | 81/177.2 |
| 5,791,805 A | * | 8/1998 | Lynch et al. | 403/374.1 |
| 5,957,516 A | | 9/1999 | Jacobs et al. | 294/57 |
| 6,070,505 A | * | 6/2000 | Dzierzbicki | 81/441 |
| 6,105,194 A | * | 8/2000 | Rudolph | 15/145 |
| 6,199,245 B1 | * | 3/2001 | Blessing | 16/430 |
| 6,254,305 B1 | | 7/2001 | Taylor | 403/378 |
| 6,553,628 B2 | * | 4/2003 | Newman et al. | 16/427 |
| 6,733,202 B2 | * | 5/2004 | Couture et al. | 403/348 |
| 6,779,235 B2 | * | 8/2004 | Newman et al. | 16/427 |
| 6,796,529 B1 | * | 9/2004 | Duran et al. | 244/129.5 |
| 2002/0020041 A1 | | 2/2002 | Newman et al. | 16/427 |

* cited by examiner

*Primary Examiner*—Robert J. Sandy
*Assistant Examiner*—Andre' L. Jackson
(74) *Attorney, Agent, or Firm*—Arthi K. Tirey; Paul R. Katterle; Robert E. McDonald

(57) ABSTRACT

A tool extension assembly including an extension pole connected to a connecting device and a tool assembly having a handle with an insert secured therein. A transversely-extending pin is movably mounted to the connecting device and is biased by a spring. The insert has a cylindrical side wall with an interior surface that defines an interior bore and interior edges that define a pair of opposing slots. The slots extend axially and circumferentially along the side wall. The connecting device is receivable in the bore of the insert such that when end portions of the pin are disposed in the slots and the handle is rotated in a first direction, the interior edges of the insert move the pin against the bias of the spring until the pin reaches end portions of the slots, at which point the pin exerts a force against the interior edges of the insert that pulls the tool assembly and the extension pole assembly together.

9 Claims, 9 Drawing Sheets

TOOL EXTENSION ASSEMBLY WITH QUICK RELEASE LOCK MECHANISM

CROSS-REFERENCE TO RELATED APPLICATION

This application claims the benefit of U.S. provisional patent application No. 60/401,992 filed on Aug. 7, 2002, the entirety of which is hereby incorporated by reference.

BACKGROUND OF THE INVENTION

The present invention relates to a tool assembly having a quick release lock mechanism for connecting a tool to an extension pole.

It is often desirable to attach an extension pole to a tool, such as a paint roller, to permit an operator to use the tool in areas normally beyond the operator's reach. Conventionally, a paint roller is provided with a handle having a threaded bore extending through an end thereof. The bore is adapted to threadably receive an externally threaded end of an extension pole. One disadvantage of such a threaded connection is that during use, the paint roller may rotate so as to unscrew the extension pole from the paint roller.

U.S. Pat. No. 5,288,160 to Graves et al. discloses a paint roller and extension pole assembly having a latching mechanism that addresses the foregoing disadvantage of a conventional threaded connection. The latching mechanism includes a locking lever pivotally mounted to the exterior of the extension pole and a latching hole formed in an exterior surface of a handle of the paint roller. The extension pole has a smooth cylindrical outer end adapted to be slidably received in a threaded bore of the paint roller. The locking lever carries a locking finger that is received in the latching hole of the handle to lock the extension pole to the handle of the paint roller. Since the latching mechanism is external to the extension pole and the paint roller, the latching mechanism is susceptible to fouling by paint, which may adversely affect its operation.

The present invention is directed to a tool assembly having a quick release lock mechanism that addresses the foregoing disadvantages of conventional quick release lock mechanisms.

SUMMARY OF THE INVENTION

The present invention discloses a tool extension assembly. In one embodiment, the tool extension assembly includes an extension pole and a tool assembly. The extension pole assembly includes an elongated extension pole, a connecting device connected to the extension pole, a pin extending through axially-extending openings and having end portions disposed exterior to the side wall of the connecting device, and a spring disposed in the hollow interior of the connecting device and operable to bias the pin toward a first position. The connecting device includes a cylindrical side wall with an interior surface defining a hollow interior. The side wall includes a pair of opposing axially-extending openings that are formed within the side wall. The pin is movable between a first position located proximate to the extension pole and a second position located distal to the extension pole The tool assembly includes an implement and a handle that is connected to the implement. The handle further has a hole formed in it. In this embodiment, an insert is securely disposed in the hole of the handle. The insert has a cylindrical side wall with an interior surface defining a bore and interior edges at least partially defining a pair of opposing slots. Each of the slots includes an opening portion and an end portion and each of said slots extends axially and circumferentially along the side wall between the opening portion and the end portion.

The connecting device is receivable in the bore of the insert such that when the end portions of the pin are disposed in the opening portions of the slots and the handle of the tool assembly is rotated in a first direction, the interior edges of the insert move the pin against the bias of the spring toward the second position until the pin reaches the end portions of the slots, at which point the pin exerts a force against the interior edges of the insert that pulls the tool assembly and the extension pole assembly together.

In an alternative embodiment, the tool extension assembly further includes a flange joined to the side wall. The flange has a plurality of interior side surfaces at least partially defining a multifaceted socket that is in communication with the bore. Moreover, the connecting device further includes a base from which the side wall extends. The base includes a plurality of side surfaces that define a multi-faceted periphery that can mate with the socket such that the base can be snugly received within the socket and prevented from rotating within the socket. When the pin exerts the force that pulls the tool assembly and the extension pole assembly together, the base is drawn into the socket, thereby preventing the tool assembly from being rotated relative to the extension pole assembly.

In an alternative embodiment, the insert may also include at least one concentric rib extending circumferentially around the side wall. In yet another embodiment, the inset may include at least one lateral rib extending along the sidewall of the insert.

BRIEF DESCRIPTION OF THE DRAWINGS

The features, aspects, and advantages of the present invention will become better understood with regard to the following description, appended claims, and accompanying drawings where:

DETAILED DESCRIPTION OF THE PREFERRED EMBODIMENTS

Figure 1:
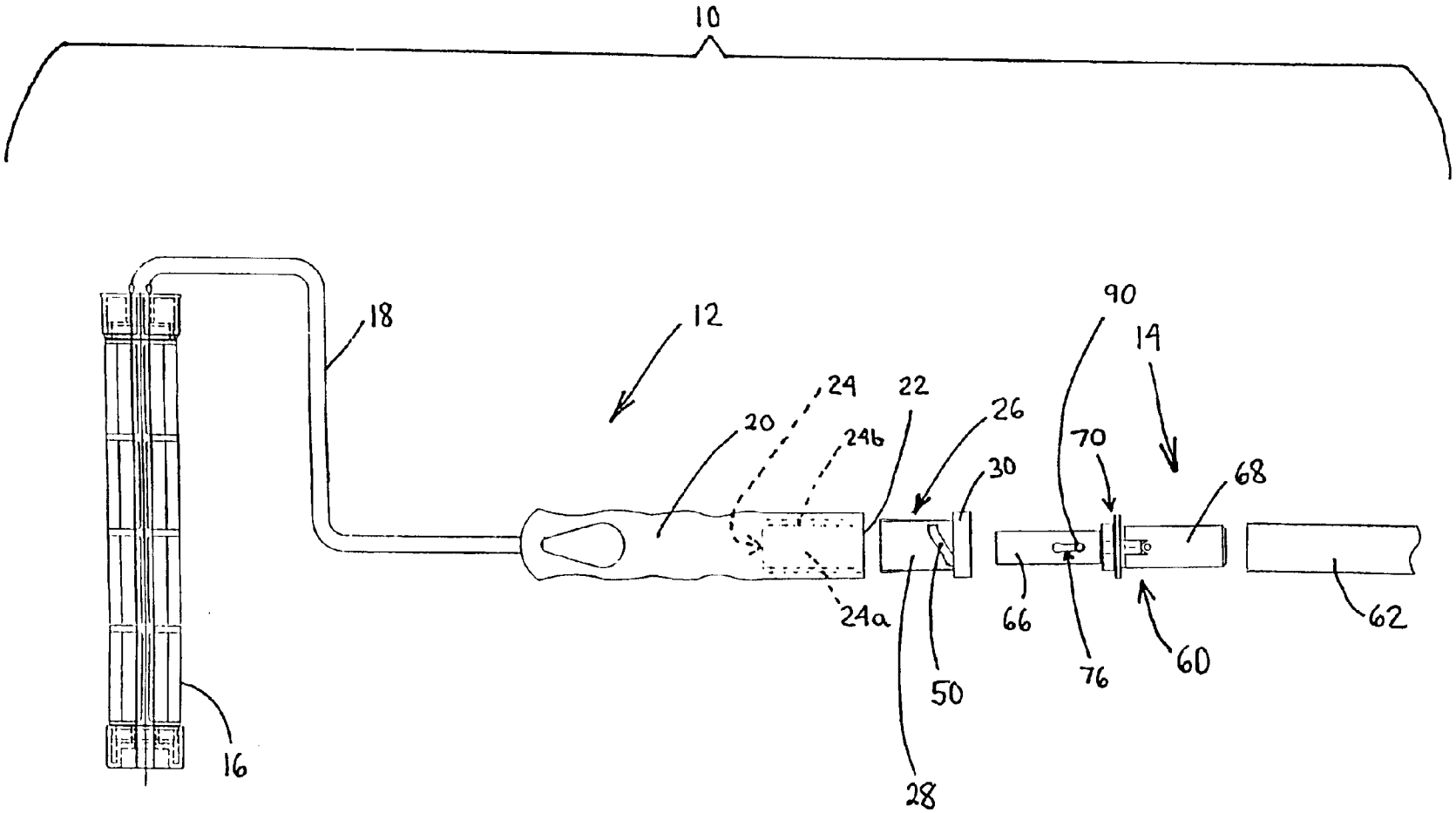
FIG. 1 shows an exploded view of a portion of a tool extension assembly embodied in accordance with the present invention.
Figure 1A:
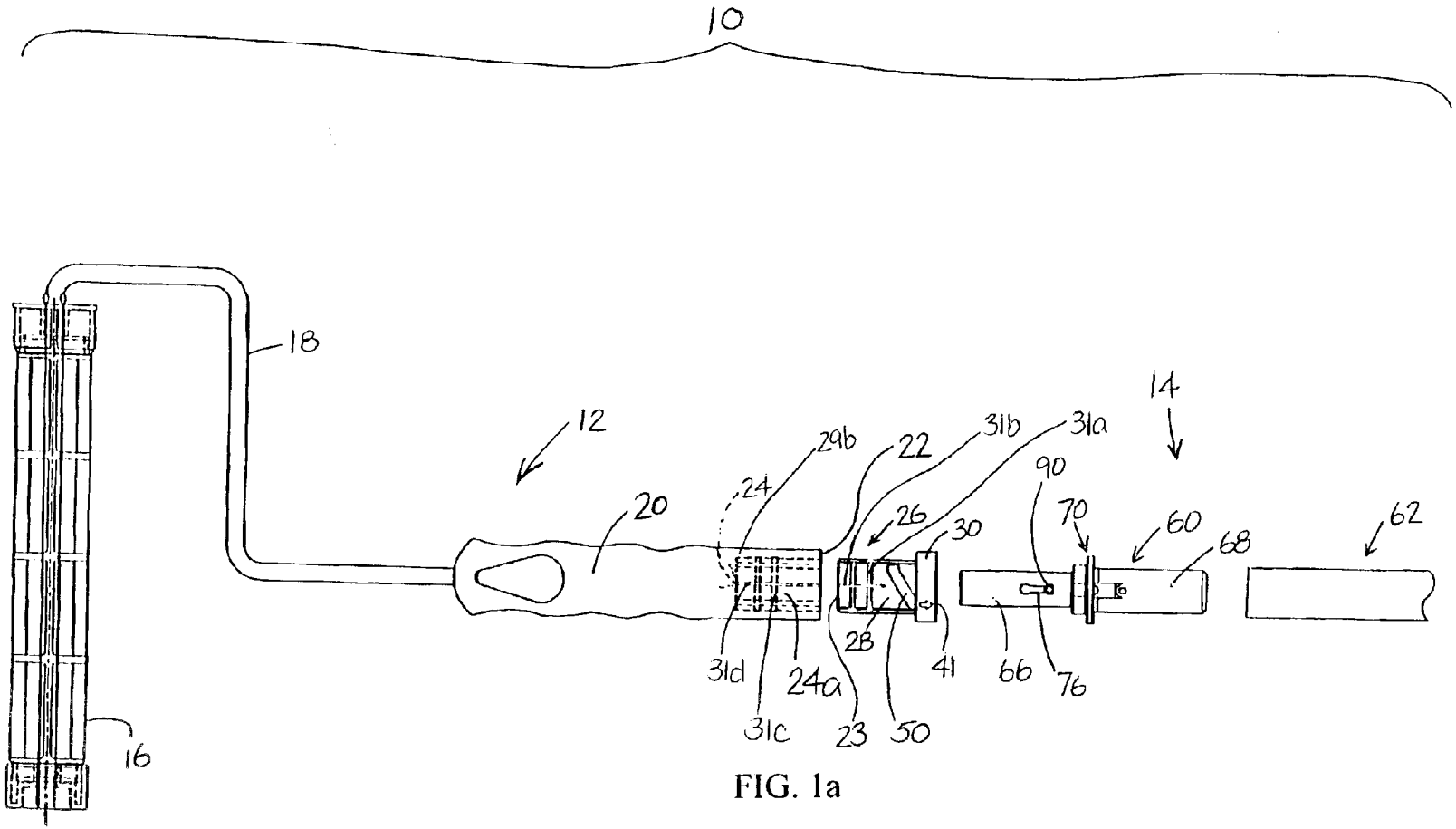
FIG. 1*a* shows an exploded view of a portion of a tool extension assembly embodied in accordance with the present invention.
Figure 1B:
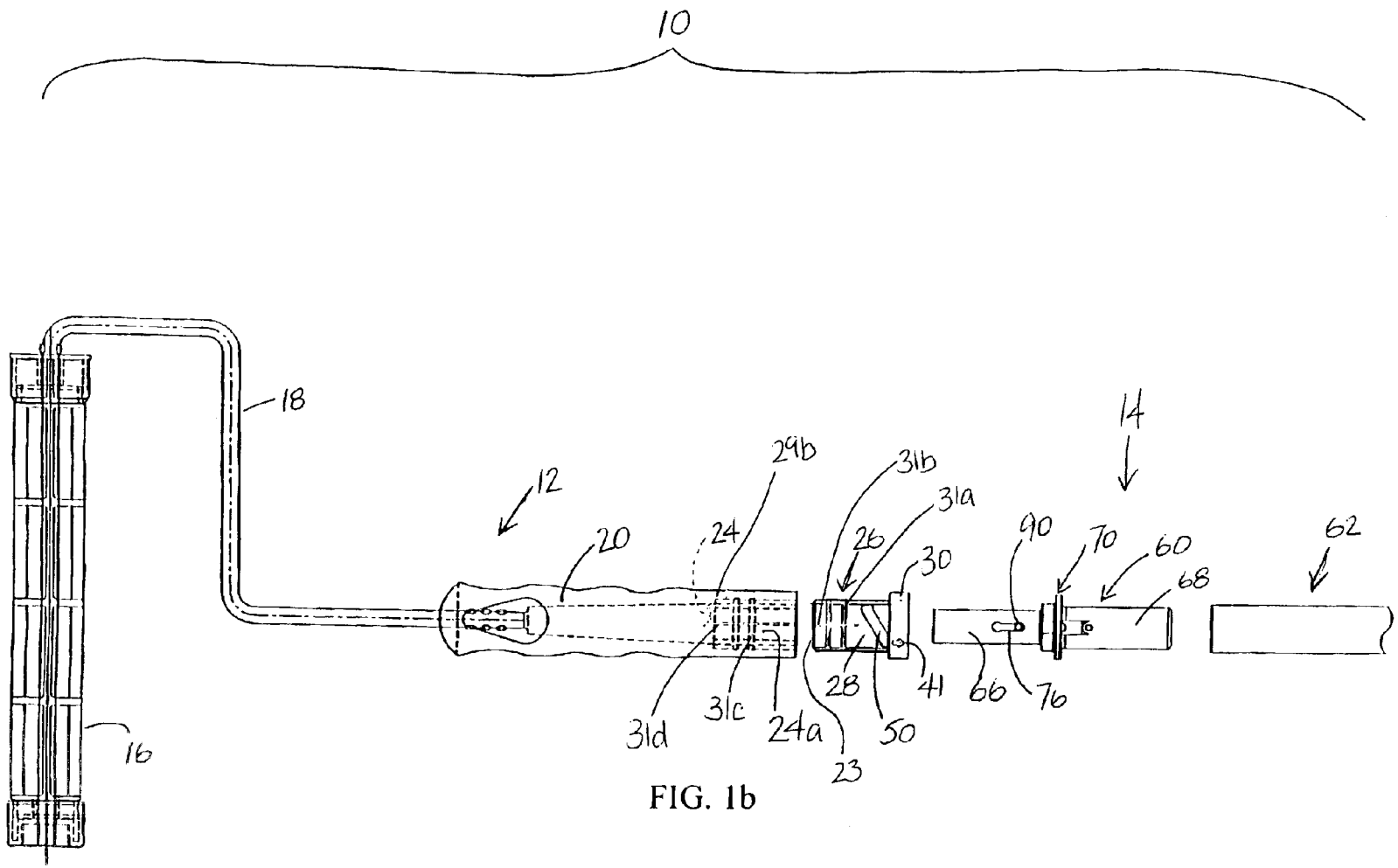
FIG. 1*b* shows an exploded view of a portion of a tool extension assembly embodied in accordance with the present invention.

It should be noted that in the detailed description that follows, identical components have the same reference numerals, regardless of whether they are shown in different embodiments of the present invention. It should also be noted that in order to clearly and concisely disclose the present invention, the drawings may not necessarily be to scale and certain features of the invention may be shown in somewhat schematic form.

Referring now to FIG. 1, there is shown an exploded view of a portion of a tool extension assembly 10 generally comprising a tool 12, such as a paint roller, and an extension pole assembly 14.

The tool 12 includes an implement 16, such as a cylindrical cage for disposal in a paint roller cover, mounted to a wire frame 18. A lower end of the frame 18 is secured to a handle 20 having a bottom end 22. The handle 20 is composed of plastic, preferably polypropylene. An axial hole 24 (shown in phantom) extends through the bottom end 22 and into the main portion of the handle 20. The hole 24 includes an enlarged main portion 24*a* and a pair of smaller side portions 24*b* that are disposed on opposing sides of the main portion 24*a*. An insert 26 is provided for securement inside the hole 24.

Figure 2A:
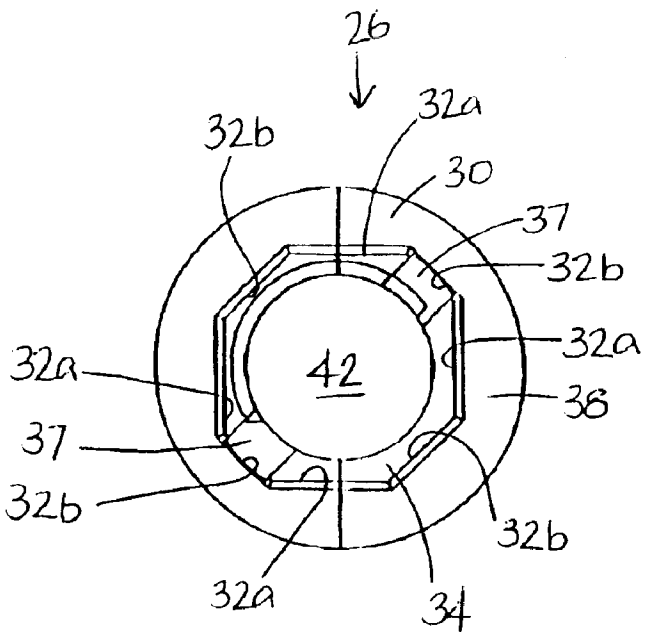
FIG. 2*a* shows an end view of an insert of the tool extension assembly.
Figure 2:
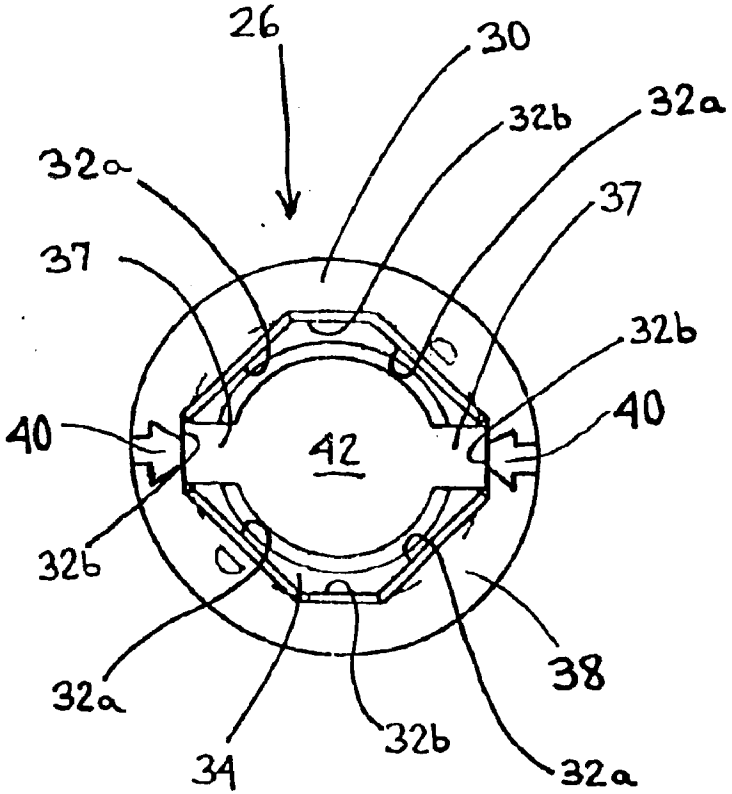
FIG. 2 shows an end view of an insert of the tool extension assembly.
Figure 3A:
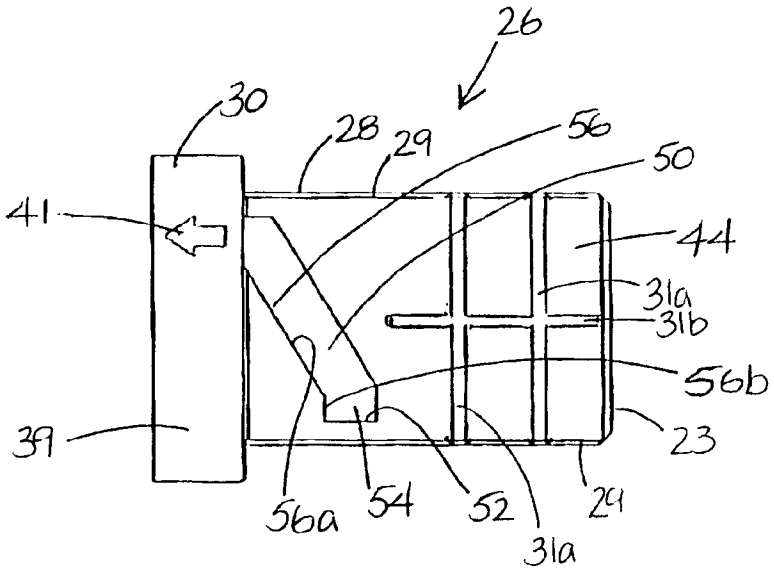
FIG. 3*a* shows a side view of the insert.
Figure 3:
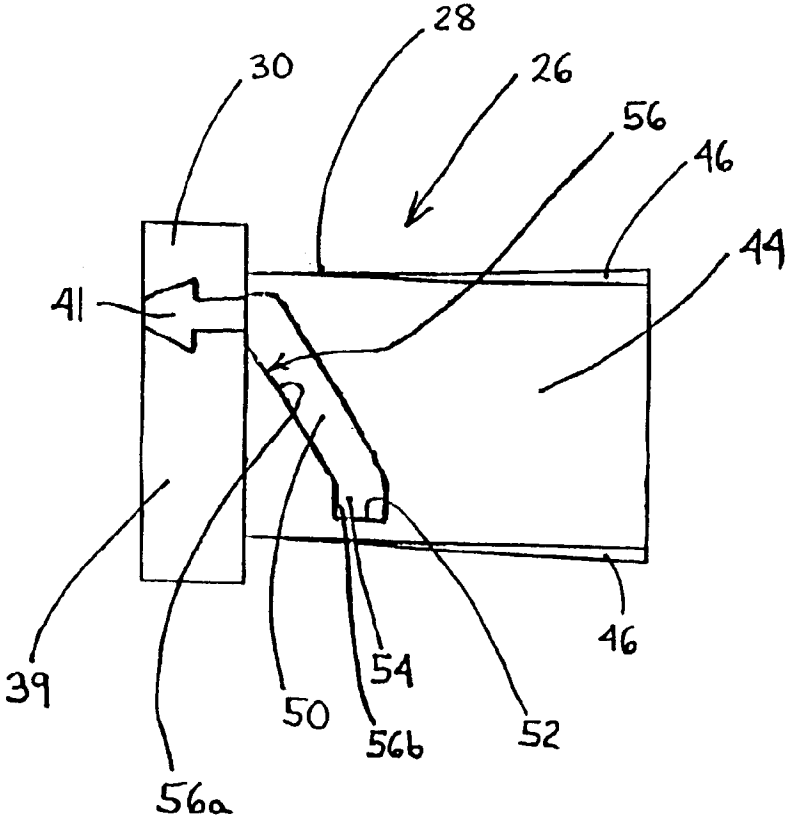
FIG. 3 shows a side view of the insert.
Figure 4:
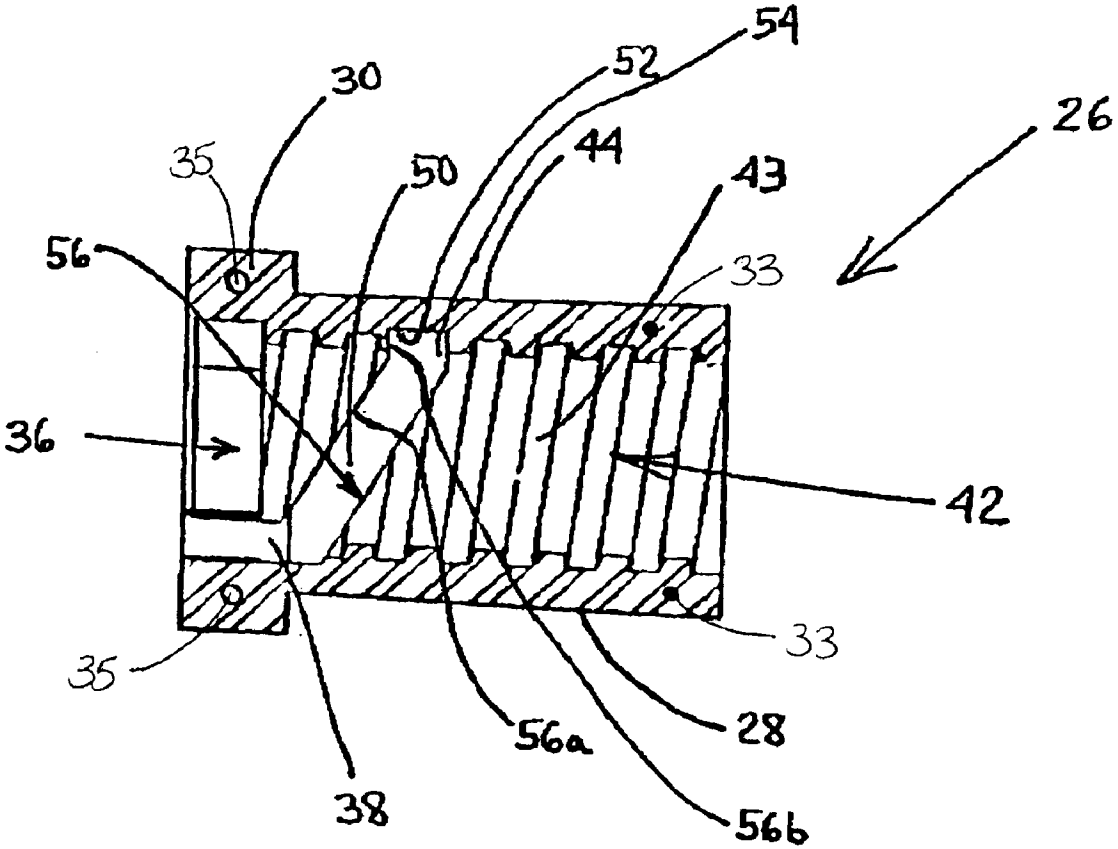
FIG. 4 shows a cross-sectional side view of the insert.

Referring now also to FIGS. 2–4, the insert 26 is composed of glass-filled nylon and includes a cylindrical body 28 joined at an inner end to an annular flange 30.

The flange 30 includes two pairs of opposing major interior side surfaces 32*a*, two pairs of opposing minor interior side surfaces 32*b* and a bottom surface 34. The minor interior side surfaces 32*b* are disposed between the major interior side surfaces 32*a*. The major interior side surfaces 32*a*, the minor interior side surfaces 32*b* and the bottom surface 34 cooperate to define an octagonal socket 36. Opening portions 37 of a pair of slots 50 extend through the bottom surface 34 and are aligned with a pair of the minor interior side surfaces 32*b*. In one embodiment, an exterior end surface 38 and an exterior side surface 39 of the flange 30 are respectively provided with markings 40, 41 that are radially aligned with the opening portions 37 and provide an exterior indication of where the opening portions 37 are located. In an alternative embodiment, only the exterior side surface 39, and not the exterior end surface 38, bears marking 41. A bore 42 extends axially through the body 28 and into the socket 36 through the bottom surface 34. The bore 42 is defined by an interior surface 43 having a helical thread formed therein.

The body 28 includes a cylindrical sidewall 44 having an exterior surface with a pair of opposing wings 46 joined thereto. The slots 50 extend through opposing portions of the sidewall 44 and extend circumferentially and axially toward an outer end of the insert 26. The slots 50 terminate at closed ends 52. Toward the closed ends 52, the slots 50 stop extending axially and only extend circumferentially, thereby forming landings 54. Each of the slots 50 is partially defined by a lower interior edge 56 having a cam portion 56*a* that functions as a cam surface (as will be discussed more fully below) and a landing portion 56*b* that helps define the landing 54 and is disposed perpendicular to the axis of the body 28.

The body 28 of the insert 26 is press fit into the hole 24 soon after the handle 20 is formed and when the handle 20 is still warm. The body 28 of the insert 26 is positioned in the main portion 24*a* of the hole 24, while the wings 46 are disposed in the side portions 24*b* of the hole 24. When the handle 20 cools and shrinks, the insert 26 becomes securely disposed in the handle 20. The wings 46 help secure the insert 26 inside the hole 24 and help prevent the insert 26 from rotating inside the hole 24.

In an alternative embodiment, one or more of the opposing wings 46 are replaced by at least one side lateral rib 29. The side lateral ribs 29 are present on the cylindrical sidewall 44. The side lateral ribs 29 are placed on the cylindrical sidewall 44 when the insert is molded in one piece, or (as described below) may appear on the insert by joining two or more pieces of the insert together.

In another embodiment, the insert 26 includes at least one mid-lateral rib 31*b*, which is equidistant from each side lateral rib 29. In one embodiment, the length of the mid-lateral rib 31*b* is anywhere from the top end of the insert 23, up to the slots 50. In one preferred embodiment, the insert includes two side lateral ribs 29 and two mid-lateral ribs 31*b*, with the mid-lateral ribs appearing 90° from each side lateral rib. Accordingly, in one preferred embodiment, the insert will have a lateral rib (either a side lateral rib or a mid-lateral rib) every 90° on the surface of the insert.

The insert 26 may also include one or more concentric ribs 31*a* on the cylindrical sidewall 44. The concentric ribs 31*a* may be placed anywhere from top end of the insert 23 to the slots 50. In one preferred embodiment, the cylindrical sidewall 44 includes two concentric ribs 31*a*.

Figure 4B:
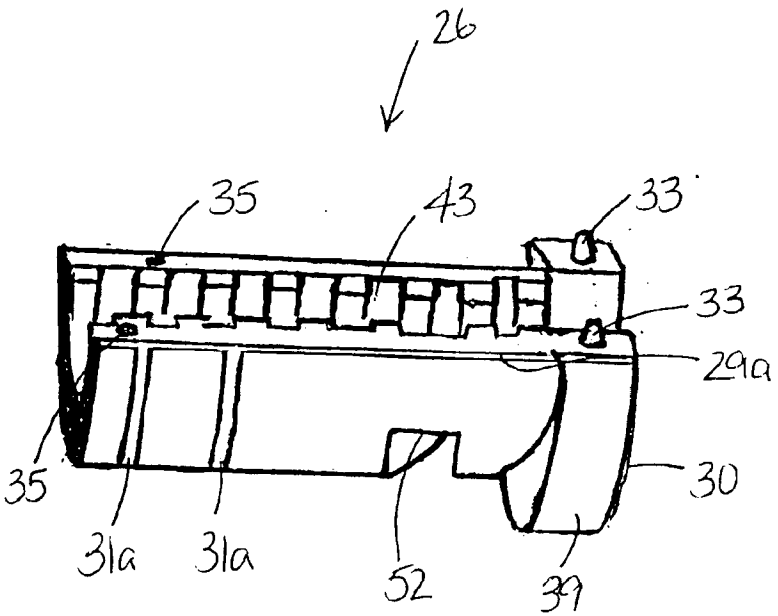
FIG. 4*b* shows a cross-sectional view of the insert.
Figure 4A:
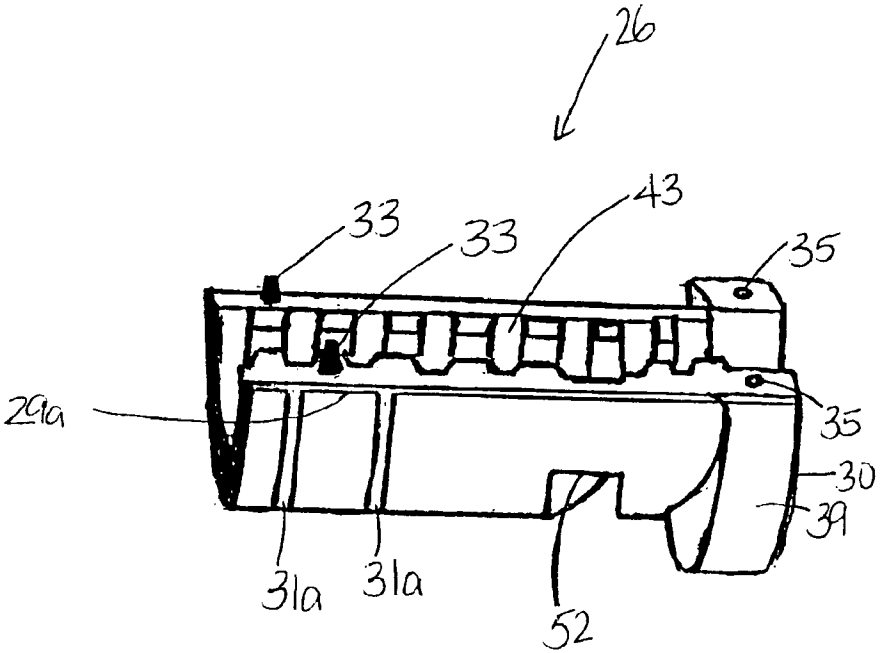
FIG. 4*a* shows a cross-sectional view of the insert.

The insert may be molded in one piece or in two or more pieces, as desired. FIGS. 4*a* and 4*b* illustrate an insert that may be molded in two pieces. The two pieces of the insert are fitted together by using a peg and hole configuration. Each peg 33 is aligned with a corresponding receiving peg hole 35 in order to prevent the separate pieces of the insert from rotating inside the hole 24 once the separate insert pieces are fitted together. In one embodiment, pegs 33 are placed on the interior surface of the flange (as seen in FIG. 4*b*) and toward the top end of the insert 23 (as seen in FIG. 4*a*). Additionally, this embodiment includes at least one receiving peg hole 35 aligned to accept the pegs. Though all pegs may be placed on one of the two-pieces and all receiving peg holes may be placed on the other piece, such a configuration does not prevent the possibility that two pieces of the insert bearing only receiving peg holes will be placed together to form the insert. Therefore, in one preferred embodiment, each piece of the insert includes at least one peg and one receiving peg hole.

In one embodiment, each piece of the insert includes a partial side lateral rib 29*a*. When the separate pieces of the insert are fitted together, the partial side lateral rib from each insert piece forms a side lateral rib 29.

When mounted in the handle 20 as described above, the insert 26 permits the handle 20 and, thus, the tool 12 to be connected to the extension pole assembly 14 (as described below) as well as to a conventional extension pole with a threaded male connector. With the conventional extension pole, the male connector is simply threaded into the bore 42 so that the threads of the male connector mate with the threads of the interior surface 43 to securely retain the mail connector in the bore 42.

The hole 24 of the handle 20 may include one or more side lateral receiving grooves 29*b*, in which the side lateral rib 31*b* is fit. The hole 24 of the handle 20 may also include one or more concentric receiving grooves 31*c*, into which the concentric rib 31*a* fits. The hole 24 of the handle may include one or more mid-lateral receiving grooves 31*d*, into which the mid-lateral rib 31*b* is fit. The grooves 29*b*, 31*c* and 31*d* are designed to accept the corresponding ribs so that the insert does not dislodge from or twist around in the hole 24 of the handle 20.

Figure 5:
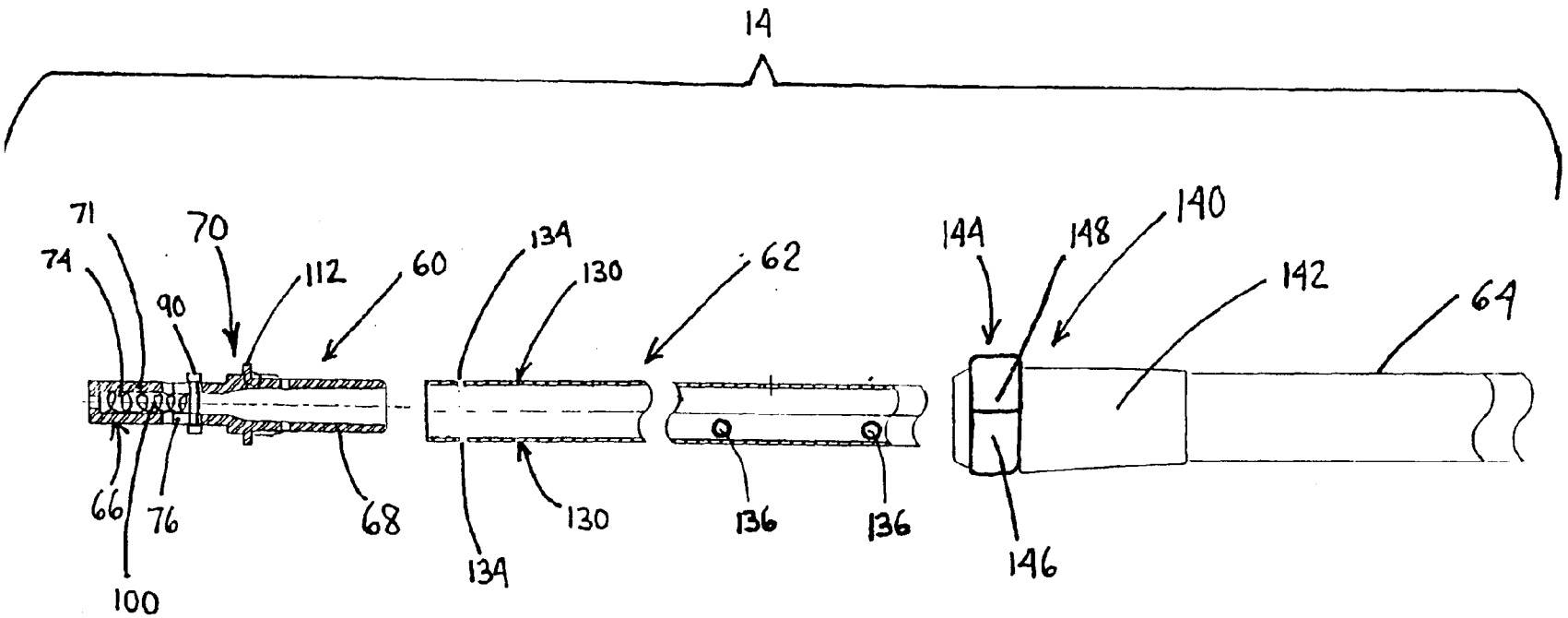
FIG. 5 shows an exploded view of an extension pole assembly of the tool extension assembly.
Figure 6:
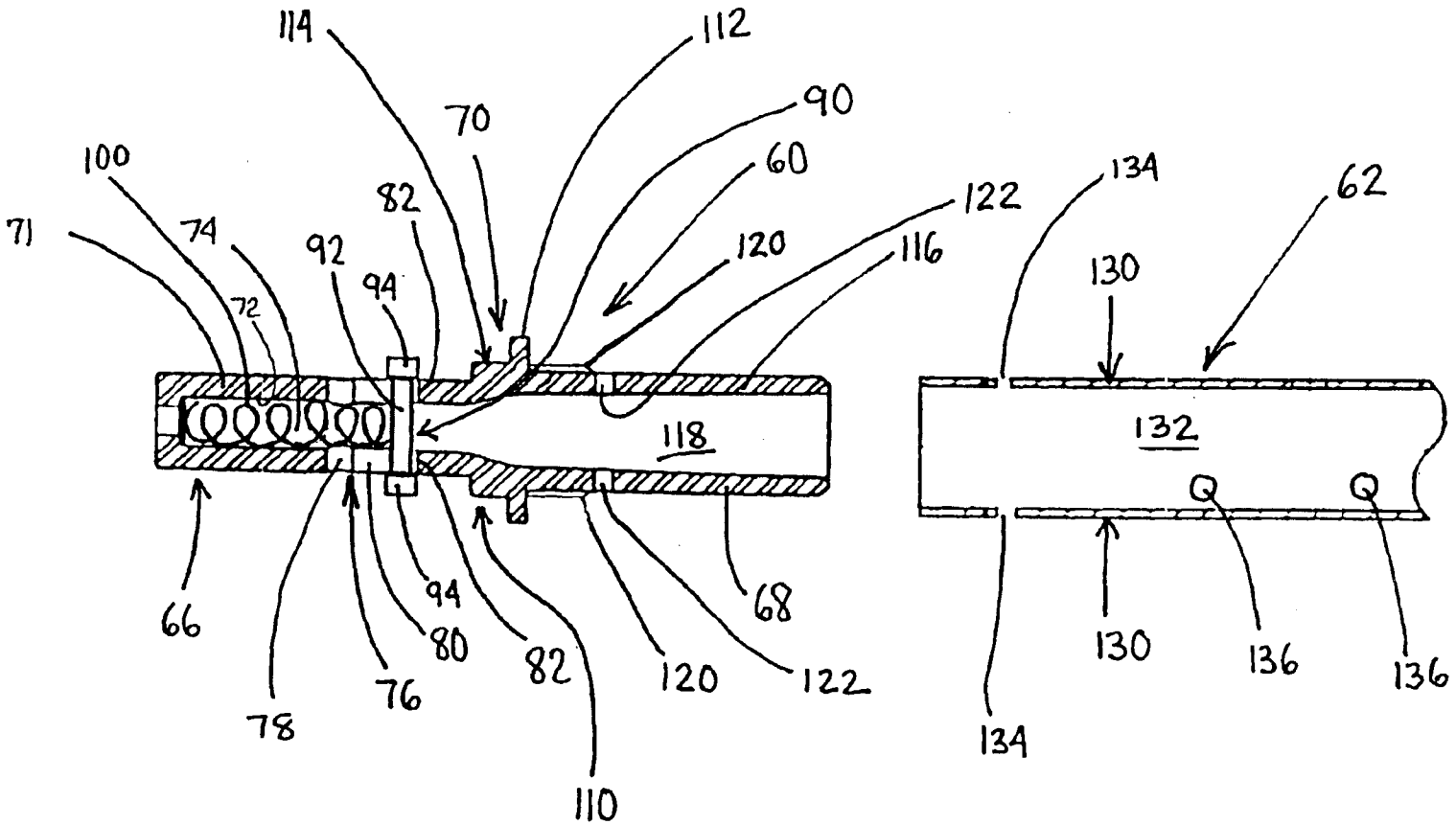
FIG. 6 shows a cross-sectional view of a connecting insert and a portion of an extension pole of the extension pole assembly.

Referring now to FIGS. 5 and 6, the extension pole assembly 14 generally includes a connecting insert 60, an inner extension pole 62 and an outer extension pole 64.

The connecting insert 60 is composed of metal and includes a connecting head 66 joined to an elongated body 68 at a middle collar section 70.

The connecting head 66 has a cylindrical side wall 71 with an interior surface 72 defining a hollow interior 74. The side wall 71 has a pair of axial slots 76 formed therein. The slots 76 are disposed on opposing sides of the side wall 71 and are aligned to help define a slotted passage extending transversely through the connecting head 66. Each slot 76 has a generally key-hole shape, with an enlarged entrance portion 78 disposed toward a free end of the connecting head 66 and a more narrow main portion 80 disposed toward the collar section 70. The main portions 80 terminate at closed ends 82 proximate to the collar section 70.

The pin 90 is disposed in the slotted passage of the connecting head 66 and extends through the slots 76. The pin 90 is dumb-bell shaped, having a rod-shaped middle portion 92 joined between a pair of enlarged cylindrical end portions 94. The end portions 94 are disposed exterior to the side wall 71, while the middle portion 92 is disposed interior to the side wall 71. The pin 90 is initially inserted into the slotted passage by aligning one of the end portions 94 of the pin 90 with one of the entrance portions 78 of the slots 76, then moving the pin 90 in a direction perpendicular to the axis of the connecting head 66 until the middle portion 92 is fully disposed in the slotted passage and then moving the pin 90 axially toward the closed ends 82. The pin 90 is axially movable in the slotted passage between the entrance portions 78 and the closed ends 82. A spring 100 is disposed in the interior 74 of the connecting head 66 and biases the pin 90 toward the closed ends 82.

The collar section 70 includes an annular base 110 joined to an annular flange 112. The base 110 has eight side surfaces 114 that define an octagonal periphery that mates with the socket 36 of the insert 26 such that base 110 can be snugly received within the socket 36 and prevented from rotating therein.

The body 68 of the connecting insert 60 has a cylindrical side wall 116 and a hollow interior 118. A pair of ramps 120 are joined to opposing portions of the side wall 116, respectively. Inner ends of the ramps 120 are located proximate to the flange 112. The ramps 120 have planar outer surfaces that are disposed parallel to each other and to the axis of the body 68. A pair of holes 122 are formed in the side wall 116, proximate to outer end ends of the ramps 120, respectively.

The inner extension pole 62 is elongated and has six planar outer surfaces 130 that provide the inner extension pole 62 with a hexagonal cross-section. The inner extension pole 62 is preferably composed of metal, such as aluminum, and has a hollow interior 132 sized to receive the body 68 of the connecting insert 60 therein. A pair of mounting holes 134 are formed in an opposing pair of the outer surfaces 130, respectively. A plurality of apertures 136 are provided in spaced-apart relationship along the length of one of these outer surfaces 130. The mounting holes 134 are positioned such that when the body 68 of the connecting insert 60 is inserted into the bore 132 and an inner end of the inner extension pole 62 abuts the flange 112, the mounting holes 134 can be aligned with the holes 122 in the body 68. When the holes 122, 134 are so aligned, screws (not shown) are threaded therethrough so as to secure the inner extension pole 62 to the connecting insert 60. The outer surfaces of the ramps 120 abut the pair of surfaces 130 with the mounting holes 134 extending therethrough, thereby providing stability to the connection between the inner extension pole 62 and the connecting insert 60.

An outer end of the inner extension pole 62 is disposed inside the outer extension pole 64. The inner extension pole 62 is telescopically movable within the outer extension pole 64 between extended and retracted positions. A locking assembly 140 is provided for releasably locking together the inner extension pole 62 and the outer extension pole 64 in a plurality of different relative positions. Preferably, the locking assembly 140 has the construction of a locking mechanism disclosed in U.S. Pat. No. 6,254,305 to Taylor, which is assigned to the assignee of the present application and which is hereby incorporated by reference. The locking assembly 140 is secured to the outer extension pole 64 and includes a collar member 142 and a locking trigger mechanism 144 comprising a bottom trigger member 146 and a top trigger member 148 having a locking pin (not shown) therein. The top trigger member 148 grippingly engages the collar member 142, which is attached to the outer extension pole 64. By depressing the bottom trigger member 146, the top trigger member 148 moves laterally outwardly retracting the locking pin from one of the apertures 136 in the inner extension pole 62, thereby permitting the length of the extension pole assembly 14 to be telescopically adjusted. By releasing the bottom trigger member 146, the top trigger member 148 moves laterally inwardly causing the locking pin to be received within another one of the apertures 136 in the inner extension pole 62 so as to interlock the inner extension pole 62 within the outer extension pole 64 at the approximate desired length of the extension pole assembly 14.

The inner extension pole 62 with the connecting insert 60 is secured to the tool 12 by axially inserting the connecting head 66 into the bore 42 in the insert 26 (which is secured in the handle 20) such that the end portions 94 of the pin 90 enter the slots 50 through the opening portions 37 in the flange 30 of the insert 26. While maintaining the axial positions of the connecting head 66 and the insert 26, the handle 20 is rotated in a first direction that causes the end portions 94 to move over the lower interior edges 56 of the slots 50, toward the closed ends 52. The cam portions **56*a* of the lower interior edges 56 act like cam surfaces and move the pin 90 in the slotted passage, toward the entrance portions 78, against the bias of the spring 100. When the end portions 94 of the pin 90 are positioned in the landings 54, at the closed ends 52 of the slots 50, the bias of the spring 100 pulls the handle 20 toward the inner extension pole 62 such that the base 110 of the connecting insert 60 enters the socket 36 of the insert 26. With the base 110 disposed in the socket 36, the handle 20 is prevented from rotating relative to the inner extension pole 62. With the end portions 94 of the pin 90 disposed in the landings 54, the landing portions 56*b* of the lower interior edges 56 are trapped between the pin 90 and the flange 112 of the connecting insert 60, with the pin 90 (as a result of the bias of the spring 100) applying a connecting force that draws the handle 20 toward the inner extension pole 62. In this manner, the inner extension pole 62 is firmly secured to the handle 20 of the tool 12. The inner extension pole 62 is removed from the tool 12 by axially moving the handle 20 away from the inner extension pole 62 so as to remove the base 110 from the socket 36. The handle 20 is then rotated in a second direction (opposite the first direction) and the connecting head 66 is axially moved out of the bore 42 in the insert 26**.

It should be appreciated that the present invention is not limited to the embodiment shown herein, wherein the tool 12 is a paint roller. The tool 12 can be a broom head, a swimming pool net, a cutting device for pruning trees, or another type of tool.

While the invention has been shown and described with respect to particular embodiments thereof, those embodiments are for the purpose of illustration rather than limitation, and other variations and modifications of the specific embodiments herein described will be apparent to those skilled in the art, all within the intended spirit and scope of the invention. Accordingly, the invention is not to be limited in scope and effect to the specific embodiments herein described, nor in any other way that is inconsistent with the extent to which the progress in the art has been advanced by the invention.

We claim:

1. A tool extension assembly comprising:

(a.) an extension pole assembly comprising:
an elongated extension pole;
a connecting device connected to the extension pole, said connecting device having a cylindrical side wall with an interior surface defining a hollow interior, said side wall having a pair of opposing axially-extending openings formed therein;
a pin extending through the axially-extending openings and having end portions disposed exterior to the side wall of the connecting device, said pin being movable between a first position located proximate to the extension pole and a second position located distal to the extension pole; and
a spring disposed in the hollow interior of the connecting device and operable to bias the pin toward the first position;

(b.) a tool assembly comprising:
an implement;
a handle connected to the implement and having a hole formed therein;
an insert securely disposed in the hole of the handle, said insert having a cylindrical side wall with an interior surface defining a bore and interior edges at least partially defining a pair of opposing slots, each of said slots having an opening portion and an end portion and each of said slots extending axially and circumferentially along the side wall between the opening portion and the end portion;

(c.) wherein said insert further comprises at least one concentric rib extending circumferentially around the side wall of the insert; and (d.) wherein said connecting device is receivable in the bore of the insert such that when said end portions of the pin are disposed in the opening portions of the slots and the handle of the tool assembly is rotated in a first direction, the interior edges of the insert move the pin against the bias of the spring toward the second position until the pin reaches the end portions of the slots, at which point the pin exerts a force against the interior edges of the insert that pulls the tool assembly and the extension pole assembly together.

2. The tool extension assembly of claim 1, wherein said insert further comprises a flange joined to the side wall, said flange having a plurality of interior side surfaces at least partially defining a multifaceted socket that is in communication with the bore; and wherein the connecting device further comprises a base from which the side wall extends, said base having a plurality of side surfaces that define a multi-faceted periphery that can mate with the socket such that the base can be snugly received within the socket and prevented from rotating therein; and wherein when the pin exerts the force that pulls the tool assembly and the extension pole assembly together, the base is drawn into the socket, thereby preventing the tool assembly from being rotated relative to the extension pole assembly.

3. A tool extension assembly comprising:

(a.) an extension pole assembly comprising:
an elongated extension pole;
a connecting device connected to the extension pole, said connecting device having a cylindrical side wall with an interior surface defining a hollow interior, said side wall having a pair of opposing axially-extending openings formed therein;
a pin extending through the axially-extending openings and having end portions disposed exterior to the side wall of the connecting device, said pin being movable between a first position located proximate to the extension pole and a second position located distal to the extension pole; and
a spring disposed in the hollow interior of the connecting device and operable to bias the pin toward the first position;

(b.) a tool assembly comprising:
an implement;
a handle connected to the implement and having a hole formed therein;
an insert securely disposed in the hole of the handle, said insert having a cylindrical side wall with an interior surface defining a bore and interior edges at least partially defining a pair of opposing slots, each of said slots having an opening portion and an end portion and each of said slots extending axially and circumferentially along the side wall between the opening portion and the end portion;

(c.) wherein said insert further comprises at least one concentric rib extending circumferentially around the side wall; and (d.) wherein said connecting device is receivable in the bore of the insert such that when said end portions of the pin are disposed in the opening portions of the slots and the handle of the tool assembly is rotated in a first direction, the interior edges of the insert move the pin against the bias of the spring toward the second position until the pin reaches the end portions of the slots, at which point the pin exerts a force against the interior edges of the insert that pulls the tool assembly and the extension pole assembly together.

4. The tool extension assembly of claim 3, wherein said insert further comprises a flange joined to the side wall, said flange having a plurality of interior side surfaces at least partially defining a multifaceted socket that is in communication with the bore; and wherein the connecting device further comprises a base from which the side wall extends, said base having a plurality of side surfaces that define a multi-faceted periphery that can mate with the socket such that the base can be snugly received within the socket and prevented from rotating therein; and wherein when the pin exerts the force that pulls the tool assembly and the extension pole assembly together, the base is drawn into the socket, thereby preventing the tool assembly from being rotated relative to the extension pole assembly.

5. The tool extension assembly of claim 3, wherein said insert further comprises at least one lateral rib extending along the sidewall of the insert.

6. A tool extension assembly comprising:

(a.) an extension pole assembly comprising:

an elongated extension pole;

a connecting device connected to the extension pole, said connecting device having a cylindrical side wall with an interior surface defining a hollow interior, said side wall having a pair of opposing axially-extending openings formed therein;

a pin extending through the axially-extending openings and having end portions disposed exterior to the side wall of the connecting device, said pin being movable between a first position located proximate to the extension pole and a second position located distal to the extension pole; and a spring disposed in the hollow interior of the connecting device and operable to bias the pin toward the first position;

(b.) a tool assembly comprising:

an implement;

a handle connected to the implement and having a hole formed therein;

an insert securely disposed in the hole of the handle, said insert having a cylindrical side wall with an interior surface defining a bore and interior edges at least partially defining a pair of opposing slots, each of said slots having an opening portion and an end portion and each of said slots extending axially and circumferentially along the side wall between the opening portion and the end portion; and (c.) wherein said connecting device is receivable in the bore of the insert such that when said end portions of the pin are disposed in the opening portions of the slots and the handle of the tool assembly is rotated in a first direction, the interior edges of the insert move the pin against the bias of the spring toward the second position until the pin reaches the end portions of the slots, at which point the pin exerts a force against the interior edges of the insert that pulls the tool assembly and the extension pole assembly together.

7. The tool extension assembly of claim 6, wherein said insert further comprises a flange joined to the side wall, said flange having a plurality of interior side surfaces at least partially defining a multifaceted socket that is in communication with the bore; and wherein the connecting device further comprises a base from which the side wall extends, said base having a plurality of side surfaces that define a multi-faceted periphery that can mate with the socket such that the base can be snugly received within the socket and prevented from rotating therein; and wherein when the pin exerts the force that pulls the tool assembly and the extension pole assembly together, the base is drawn into the socket, thereby preventing the tool assembly from being rotated relative to the extension pole assembly.

8. The tool extension assembly of claim 6, wherein said insert further comprises at least one concentric rib extending circumferentially around the side wall.

9. The tool extension assembly of claim 6, wherein said insert further comprises at least one lateral rib extending along the sidewall of the insert.

* * * * *